US006233966B1

(12) United States Patent
Delpuech et al.

(10) Patent No.: US 6,233,966 B1
(45) Date of Patent: May 22, 2001

(54) FREEZING TUNNEL

(75) Inventors: Bernard Delpuech, Maurepas; Nicolas Viard, Buc, both of (FR)

(73) Assignee: L'Air Liquide, Societe Anonyme pour l'Etude et Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/380,564

(22) PCT Filed: Feb. 17, 1998

(86) PCT No.: PCT/FR98/00302

§ 371 Date: Sep. 30, 1999

§ 102(e) Date: Sep. 30, 1999

(87) PCT Pub. No.: WO98/39606

PCT Pub. Date: Sep. 11, 1998

(30) Foreign Application Priority Data

Mar. 3, 1997 (FR) ..... 97 02498

(51) Int. Cl.[7] ..... F25D 25/04
(52) U.S. Cl. ..... 62/374
(58) Field of Search ..... 62/63, 374, 380

(56) References Cited

FOREIGN PATENT DOCUMENTS 0 167 405 1/1986 (EP) .

0 667 501 8/1995 (EP) .

*Primary Examiner*—Corrine McDermott
*Assistant Examiner*—Malik N. Drake
(74) *Attorney, Agent, or Firm*—Burns, Doane, Swecker & Mathis, L.L.P.

(57) ABSTRACT

A plant for the treatment of food product. The plant comprises an apparatus for cooling food products by bringing the products into contact with a cryogenic fluid, a conveyor for introducing the products into the apparatus and for extracting the products from the apparatus, and a detector which determines at least one of (i) a value representative of the quality and (ii) the quantity of products treated by the apparatus. The detector comprises a camera suitable for producing a digital image of a section of the conveyor intended for transporting the products, the digital image revealing the products carried by the section of the conveyor, a data processing unit which includes an image processor suitable for determining the at least one of (i) the value representative of the quality and (ii) the quantity of products treated by the apparatus from the digital image, and a measuring device which measures the quantity of cryogenic fluid with which the products are brought into contact, connected to the data processing unit, wherein the data processing unit computes the temperature of each product leaving the apparatus depending on the value representative of the quantity of products treated and on the measured quantity of cryogenic fluid.

14 Claims, 4 Drawing Sheets

FREEZING TUNNEL

BACKGROUND OF THE INVENTION

1. Field of the Invention

The present invention relates to a plant for the treatment of products, of the type which includes an apparatus for treating said products, the apparatus being combined with a conveyor for introducing the products into the apparatus and for extracting said products from said apparatus, the plant furthermore including means for detecting the products treated by said apparatus, these means being suitable for determining a value representative of the quality and/or the quantity of products treated by said apparatus.

The invention relates in particular to plants for the treatment of food products, for example cooking plants, or else to the deep-freezing of food products, such as portions of ground meat or fish fillets, prepared dishes, dairy products, or else Viennese breads and buns. It will be understood that the list given above cannot be regarded as exhaustive, but is in fact purely illustrative of the many possibilities in the food industry.

2. Description of the Related Art

Known deep-freezing plants include, for example, a deep-freezing tunnel right through which a belt conveyor passes, the products to be frozen being deposited on said belt conveyor. The belt conveyor circulates continuously through the deep-freezing tunnel.

The deep-freezing tunnel is supplied with a cryogenic fluid, such as liquid nitrogen or liquid carbon dioxide. This cryogenic fluid is brought into contact with the products to be treated. On contact with the products, the cryogenic fluid vaporizes, thus refrigerating the products.

It is known to place, upstream of the deep-freezing tunnels, means for detecting the products introduced into the tunnel. These means are used, for example, to determine the number of products or the mass of products treated by the tunnel. They conventionally include balances allowing the weight of the products introduced into the deep-freezing tunnel to be determined continuously.

These balances generally include a belt conveyor located upstream of the belt conveyor of the deep-freezing tunnel. Weighing devices are placed beneath the conveyor so as to continuously determine the weight of the products traveling on the conveyor. If several products, for example portions of ground meat, are placed side by side along the width of the conveyor, several weighing devices are placed side by side in the paths along which the products move.

The weighing devices used in the known detection means currently include moving parts and employ a sophisticated weighing mechanism. This mechanism is sensitive to the influence of the temperature. In particular, the weighing devices are subject to blockages due to the frost when they are used at a very low temperature.

Under these conditions, the known balances must be placed away from the deep-freezing tunnel so as to avoid malfunctions resulting from the low temperatures.

In addition, the weighing devices cannot be directly associated with the conveyor of the deep-freezing tunnel.

Consequently, it is necessary to provide means for transferring the products from the conveyor specific to the balances to the conveyor specific to the deep-freezing tunnel. The use of such transfer means causes degradation of the products during their transfer.

Again by way of illustration of the examples of applications in which it is advantageous to be able to determine the mass, size or surface area of the products entering such tunnels or apparatuses for the treatment of food products, mention may be made of the case of machine [sic] for packaging food products under packaging which traps an atmosphere containing ozone.

Thus, the following may be used, for example:

- $N_2/CO_2/O_2/O_3$ atmospheres, for example for meat products or fish products. By way of illustration, atmospheres containing 1000 to 15,000 ppm/weight of ozone, which include a few percent to a few tens of percent of oxygen and a few tens of percent of $CO_2$, will typically be used here, depending on the intended product;
- $N_2/O_2/O_3$ atmospheres, for example for vegetables (even if in some cases it may happen that, in the case of vegetables, the atmosphere includes a little $CO_2$), such atmospheres typically containing up to 1500 ppm/weight of ozone, depending on the intended product.

However, it has moreover been clearly demonstrated that ozone reacts more depending on the area of the product in question than, for example, depending on its mass or its volume. It will therefore be understood that it is very advantageous to determine the surface area of the entering products correctly, so that, for example, the quantity of ozone produced by the ozonizer is subject to feedback control so as to efficiently adapt to this area, for example according to a pre-established calibration curve.

SUMMARY AND OBJECTS OF THE INVENTION

The object of the invention is to provide a solution to the drawbacks mentioned above and, in particular, to provide a plant for the treatment of products which detects the products treated by the apparatus directly on the conveyor associated with the apparatus and which is insensitive to the influence of temperature.

For this purpose, the subject of the invention is a plant for the treatment of products, of the aforementioned type, characterized in that said detection means include a camera suitable for producing a digital image of a section of the conveyor intended for transporting the products, said digital image revealing said products carried by said section of the conveyor, which camera is connected to a data processing unit which includes image processing means suitable for determining the value representative of the quality and/or the quantity of products treated by said apparatus from said digital image.

It will be understood that the camera associated with the image processing means makes it possible to determine a value representative of the quality and/or the quantity of products introduced into the apparatus, for example the number of products or the volume of them, or else the degree of occupancy of the conveyor, without the use of mechanical means sensitive to temperature effects. In addition, since the image is taken directly on the transfer conveyor of the treatment apparatus, the plant is compact in size and requires no transfer between characterizing means and the treatment apparatus proper.

According to particular embodiments, the invention may include one or more of the following characteristics:

- the line of sight of said camera extends so as to be approximately perpendicular to the plane of movement of said conveyor;
- said data processing unit includes means for triggering the taking of an image at predefined triggering times and said image processing means include means capable of computing a value representative of the density of products on the conveyor at each triggering time from said digital image of said section of the conveyor at that time;

said camera is a camera of the monochrome or color type;

said camera is a camera of the color type and said image processing comprises an analysis of the colors present in the image, allowing, by comparison with a reference color, said value representative of the density of products on the conveyor to be determined;

It will be understood that, according to such an embodiment, it is possible for one to be "content" with the "density of products on the conveyor" information, or else to use this information in combination with the speed of travel of the conveyor, in order to obtain the average quantity of products treated in the enclosure per unit time;

the plant includes means for placing the products on said conveyor in a predetermined pattern, reproduced sequentially along said conveyor with a variable quantity of products for each pattern, and it includes, connected to said data processing unit, means for counting the number of patterns traveling past the camera, and said data processing unit includes means for evaluating the value representative of the quantity of products treated from said value representative of the density of products on the conveyor, this being computed at each triggering time, and from the number of patterns counted;

said counting means include an optical barrier connected to said data processing unit and placed transversely to the conveyor, the beam of said barrier lying in the plane of movement of the products so as to be interrupted by the products traveling on the conveyor;

the optical barrier includes, near the conveyor, an end for the emission of the beam and an end for the reception of the beam, and these two ends are associated with nozzles for ejecting a gas for protecting said ends, especially a hot gas;

according to another embodiment of the counting means, these include, near the conveyor, an ultrasonic or microwave barrier connected to said data processing unit and placed transversely to the conveyor, the beam of said barrier lying in the plane of movement of the products (P) so as to be interrupted by the products (P) traveling on the conveyor;

said camera is a camera of the infrared type and said image processing makes it possible to obtain, apart from a value representative of the density of products on the conveyor (as in the case of the other camera types mentioned), a value representative of the temperature of the products on the conveyor;

said image processing means include means for differentiating, in said image, those areas of the conveyor that are covered by a product from those areas of the conveyor that are left free, as well as means for analyzing said differentiated areas in said image in order to determine a value representative of the quantity of products treated;

said means for analyzing said differentiated areas include means for producing, over the entire extent of the image, a first histogram representative of the number of pixels corresponding to those areas of the conveyor that are covered by a product, for each line of the image in the direction of movement of the conveyor, means for producing, over the entire extent of the image, a second histogram representative of the number of pixels corresponding to those areas of the conveyor that are covered by a product, for each line of the image in the direction perpendicular to the direction of movement of the conveyor, and means for comparing the values of the peaks of the first and second histograms thus produced with first and second threshold values for determining the density of products treated;

said treatment apparatus is an apparatus for cooling food products by bringing the products into contact with a cryogenic fluid and it includes, connected to said data processing unit, means for measuring the quantity of cryogenic fluid with which the products are brought into contact, and said data processing unit includes means for computing the temperature of each product leaving said apparatus depending on the value representative of the quantity of products treated and on the measured quantity of cryogenic fluid; and said data processing unit includes means for storing the curve of the variation in enthalpy of a product as a function of its temperature, and means for determining the exit temperature of a product from said enthalpy curve, from the measured quantity of cryogenic fluid, from the value representative of the quantity of products treated and from the initial temperature of the products.

The invention will be more clearly understood on reading the description which follows, given solely by way of example and with reference to the drawings which.

DETAILED DESCRIPTION OF PREFERRED EMBODIMENTS

Figure 1:
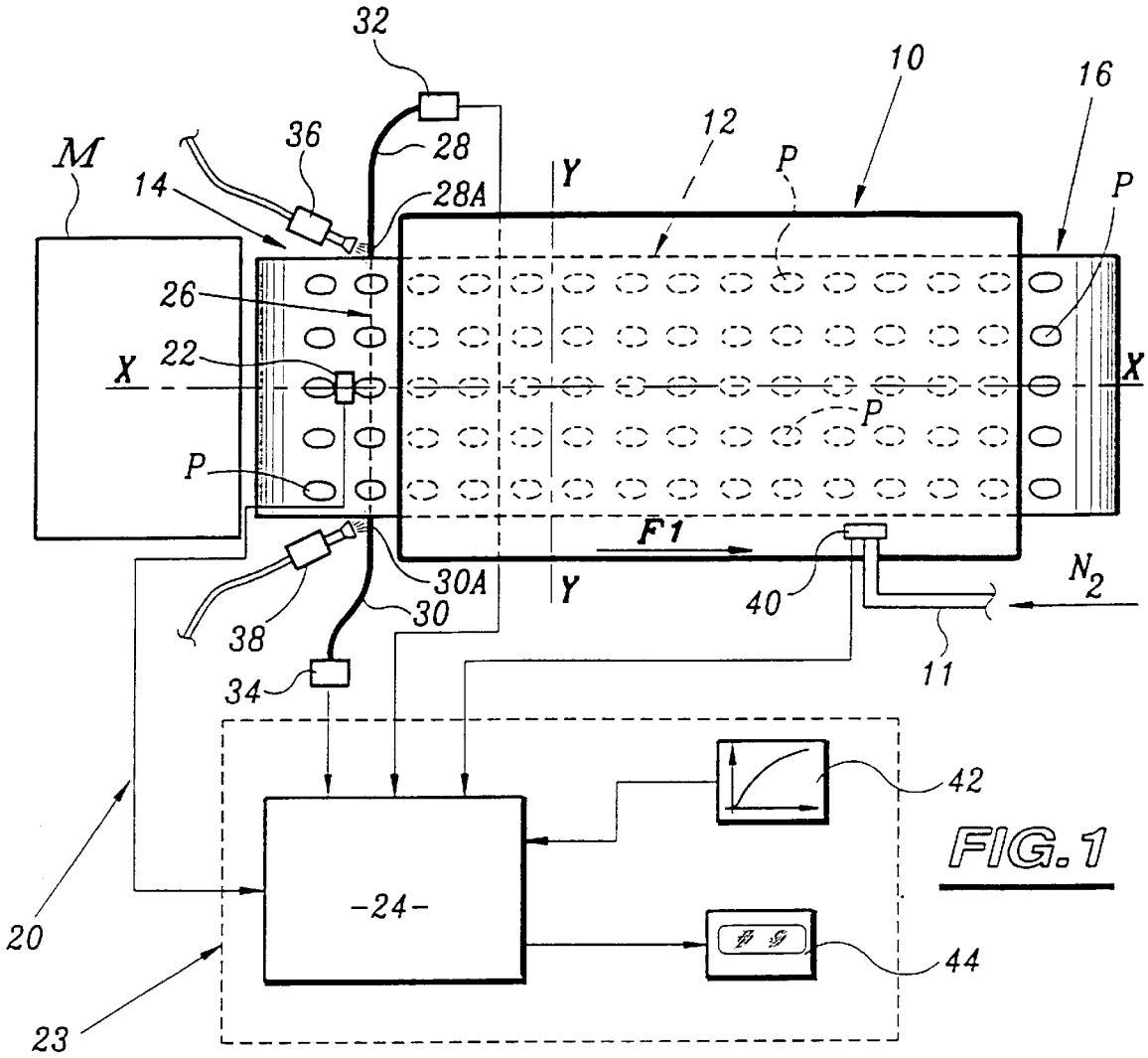
FIG. 1 is a diagrammatic view of a plant for the deep-freezing of food products, for example portions of ground meat according to the invention, the deep-freezing tunnel being seen from above.
Figure 2:
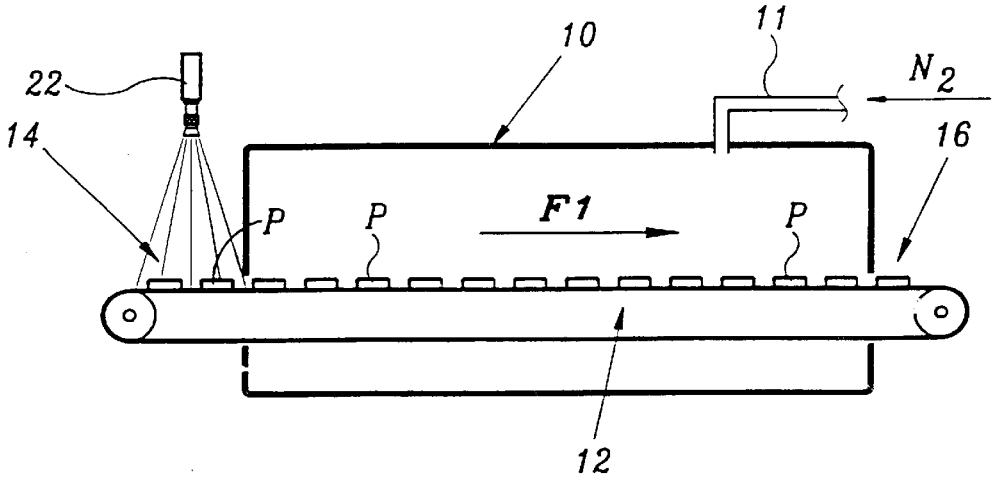
FIG. 2 is a diagrammatic side view of the deep-freezing tunnel of FIG. 1.

The plant illustrated in FIGS. 1 and 2 includes a deep-freezing tunnel 10 open at both its ends. It includes a line 11 for supplying cryogenic fluid, for example liquid nitrogen. Passing through the tunnel is a belt conveyor 12 traveling along the line X—X in the direction of the arrow F1. The conveyor projects from each side of the deep-freezing tunnel 10. In particular, it includes an incoming section 14 for introducing the products to be frozen into the tunnel and an outgoing section 16 for removing the frozen products.

The tunnel illustrated is assumed to be suitable for freezing portions of ground meat of approximately oval shape. These portions are denoted by the letter P in the figures.

The incoming section 14 of the conveyor is placed at the exit of a machine M for shaping the portions. This machine is suitable for simultaneously producing from one to six portions of ground meat.

Transfer means (not illustrated) are provided so as to remove the portions at the exit of the shaping machine M and to deposit them on the incoming section 14. In particular, the transfer means are suitable for depositing the portions P sequentially on the continuously traveling conveyor in a predefined pattern.

In the example described, the portions P are placed in lines along the width Y—Y of the conveyor 12, as illustrated in FIG. 1. Thus, the portions P are aligned in rows that may include from one to six portions, depending on the number of portions simultaneously produced by the shaping device M.

According to the invention, the plant includes means 20 for detecting the products treated in the tunnel. These means 20 include here a camera 22 connected to a data processing unit 23. The latter includes a central computing unit 24 which especially includes means for processing a digital image taken by said camera.

As illustrated in FIGS. 1 and 2, the camera 22 is placed above the incoming section 14 of the conveyor with its line of sight extending so as to be approximately perpendicular to the plane of movement of the conveyor 12.

In the case of the embodiment illustrated, the camera is suitable for taking a monochrome digital image covering most of the area of the section 14.

Figure 3:
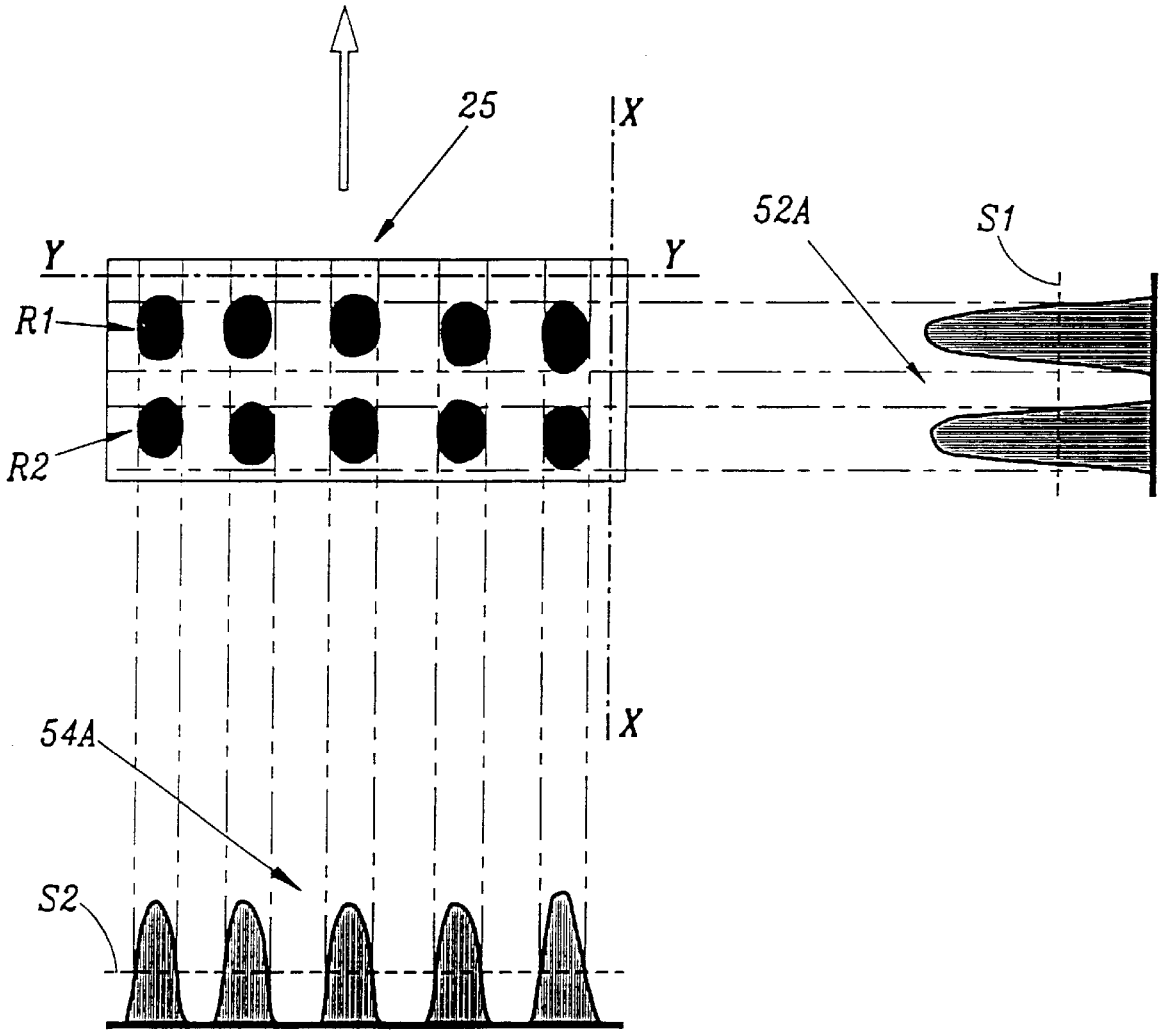
FIG. 3 is a diagrammatic view explaining the operation of the image processing means.

An example of an image taken by the camera 22 is illustrated in FIG. 3. This image, denoted by the reference 25, reveals two rows, denoted R1, R2, each having five black spots corresponding to those areas of the conveyor that are covered by a product. The area of the conveyor left free appears in white in the image 25.

The means 24 for processing the digital image are suitable for determining a value representative of the quantity of products treated by the tunnel. This quantity is, for example, the number n of products introduced, the volume of products introduced or even the degree of occupancy of the conveyor.

Figure 4:
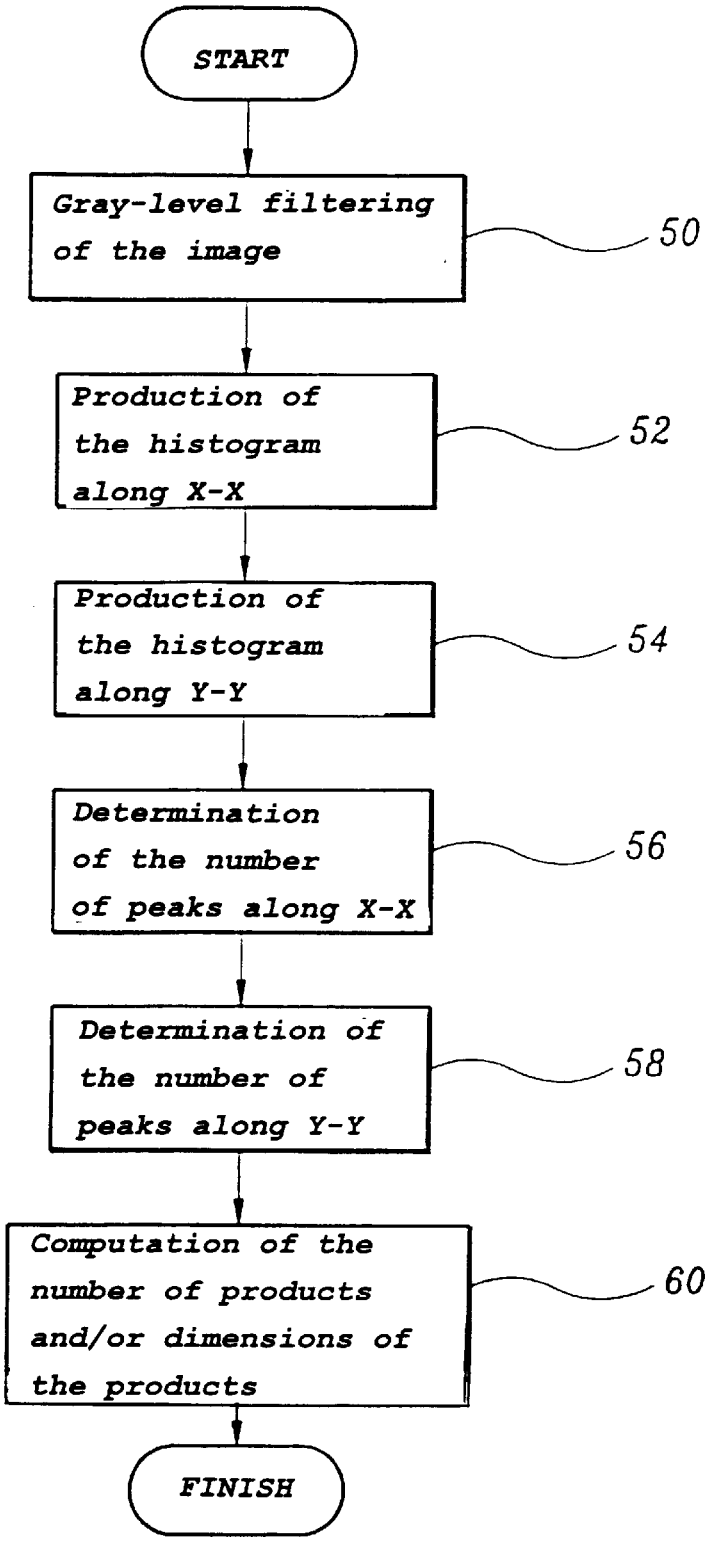
FIG. 4 is a flow chart explaining the steps carried out by the image processing means.

The central computing unit 24 is, for example, formed by a microcomputer which includes an interface for linking to the camera 22, suitable for taking a digitized image. An image processing program is loaded into the microcomputer so as to analyze the image produced by said camera. Said image processing program will be described subsequently with reference to FIG. 4.

The data processing unit 23 includes means for triggering the taking of an image at a predetermined frequency (that is to say transferring an image from the camera to the unit), which frequency will be understood to depend on the type of processing then carried out by the unit, said frequency therefore being sufficiently low to allow computer processing of the image. This frequency is, for example, about 0.3 hertz, but it may commonly vary between a few tenths of a hertz and a few tens of hertz.

Moreover, the plant illustrated in FIG. 1 includes an optical barrier 26 which has two aligned lengths of optical fiber 28, 30, the facing ends 28A, 30A of which are placed face to face on either side of the conveyor 12.

The embodiment illustrated here therefore relies on the combined use of a monochrome camera and an optical barrier.

The length 28 of optical fiber has, at its other end, a light-emitting diode 32 supplied by a source of electrical power for the purpose of producing a permanent light beam through the fiber 28. The other end of the fiber 30 is associated with a photodetector 34 connected to the central computing unit 24. The fibers 28 and 30 are placed at a level such that the light beam, traversing the conveyor along the Y—Y direction and extending from the fiber 28 to the fiber 30, is interrupted by the rows of products traveling on the conveyor.

The photodetector 34, connected to the unit 23, thus makes it possible to determine the number of interruptions of the beam, which corresponds to the number of rows of products entering the deep-freezing tunnel 10. If the products are placed in a pattern differing from a row, for example a circular arc, the optical barrier 26 exerts, in an identical manner, a function of counting the number of patterns entering the tunnel, this being so independently of the number of products contained in each pattern.

Provided at each of the free ends 28A, 30A of the optical fibers are nozzles 36, 38 for ejecting a dry gas, especially nitrogen, onto the ends of the optical fibers so as to ensure that they are protected from the effects of the cold.

These nozzles are connected to means for supplying dry gas, this gas being at a temperature greater than the temperature prevailing in the enclosure of the tunnel. The temperature of the dry gas ejected is, for example, equal to the ambient temperature (20° C.).

The central computing unit 24 is connected to a flow meter 40 suitable for determining the flow rate of cryogenic fluid introduced into the tunnel 10.

Furthermore, the unit 24 is connected to storage means 42 which include, for each type of product that can be treated in the tunnel, a curve $G_5$ specific to the product, of the variation in its enthalpy as a function of its temperature.

A display screen 44 is connected to the central computing unit 24 so as to display the temperature of the products leaving the tunnel.

The plant according to the invention operates in the following manner.

While the products are traveling continuously on the conveyor, the camera 22 takes an image of the section 14 at a given frequency and transmits it to the data processing unit 23. It is then analyzed by the image processing program.

The image processing program employed includes a first step of filtering the image coming from the camera. This first step, denoted by the reference 50 in the flow chart of FIG. 4, consists in comparing the gray level of each pixel of the image with a reference value and in replacing the pixel in question with a white pixel if the gray level is below the reference value and with a black pixel if the gray level is above the reference value. Thus, this results in an image such as that illustrated in FIG. 3 in which those areas of the conveyor that are covered by a product form black spots on a white background.

The image is positioned so that the direction of advance X—X of the conveyor extends along the height of the image and that the width Y—Y of the conveyor, the direction perpendicular to the direction of advance of the conveyor, extends along the width of the image.

At step 52, the program produces a histogram 52A of the number of black pixels along the X—X direction. This histogram represents, for each line parallel to the Y—Y axis of the digitized image, the total number of black pixels contained in this line. The computation is carried out for all the lines of the image.

As illustrated in FIG. 3, the histogram 52A has two successive peaks corresponding to the two rows R1 and R2.

In a similar manner, a histogram 54A is produced at step 54 by summing the black pixels for each line of the digitized image parallel to the X—X axis. As illustrated in FIG. 3, the histogram 54A has five peaks corresponding to the five products contained in the two rows R1 and R2.

At steps 56 and 58, the program determines the number of peaks contained in the histograms 52A and 54A.

For this purpose, the program counts, for example, for each histogram, the number of peaks whose height exceeds a predetermined reference value S1, S2 represented by a dotted line in FIG. 3.

At step 60, the program computes, from the number of peaks identified in the histograms 52A and 54A, the number of products appearing in the image and in particular the number of products per row. The latter value is indicative of the density of products on the conveyor at the instant in question.

As will be clearly apparent to those skilled in the art, the example developed above illustrates the case of products deposited in a line in a regular pattern; it will therefore be understood that, if the placement of the products on the conveyor does not follow such regularity, the algorithm used will be different.

The central computing unit 24 connected to the optical barrier 26 makes it possible to accurately determine, continuously, the number of rows of products treated by the tunnel.

The central computing unit 24 continuously determines, from the number of products per row and from the actual number of rows entering the tunnel, the number of introduced products inside the tunnel.

As a variant, at step 60 the program determines, from the height of the peaks of each histogram, the dimensions of the products in the two directions extending perpendicularly to the line of sight of the camera.

From these dimensions, the program determines the degree of occupancy of the conveyor, that is to say the ratio of the area occupied by the products to be treated to the free area of the conveyor contained in the image analyzed.

The degree of occupancy of the conveyor constitutes another value representative of the density of products on the conveyor.

As previously, the central computing unit 24 continuously determines, from the degree of occupancy of the conveyor and from the actual number of rows of products entering the tunnel, a value representative of the quantity of products entering the tunnel at the given instant. This value is, for example, the degree of occupancy multiplied by the number of rows entering the tunnel per unit time.

It will be understood that, in the two variants, although the camera 22 does not provide an image of all the products entering the tunnel, because of the high speed of travel of the conveyor and because of the relative slowness of the computing unit, it is possible, by the combined use of the camera and of the optical barrier, to accurately determine a value representative of the quantity of products treated in the plant.

For the purpose of computing the temperature Ts of the products leaving the tunnel, the central computing unit 24 includes a program allowing this temperature to be continuously determined from a stored curve $G_5$ of the variation in the enthalpy, from the volume q of cryogenic fluid introduced into the tunnel per unit time, from the pressure and from the temperature of the cryogenic fluid, as well as from the number n of products, the mass of which is known, introduced per unit time into the tunnel and from their entrance temperature Te. In the example described, the cryogenic fluid is liquid nitrogen. It could be replaced by carbon dioxide, argon or any other fluid.

Figure 5:
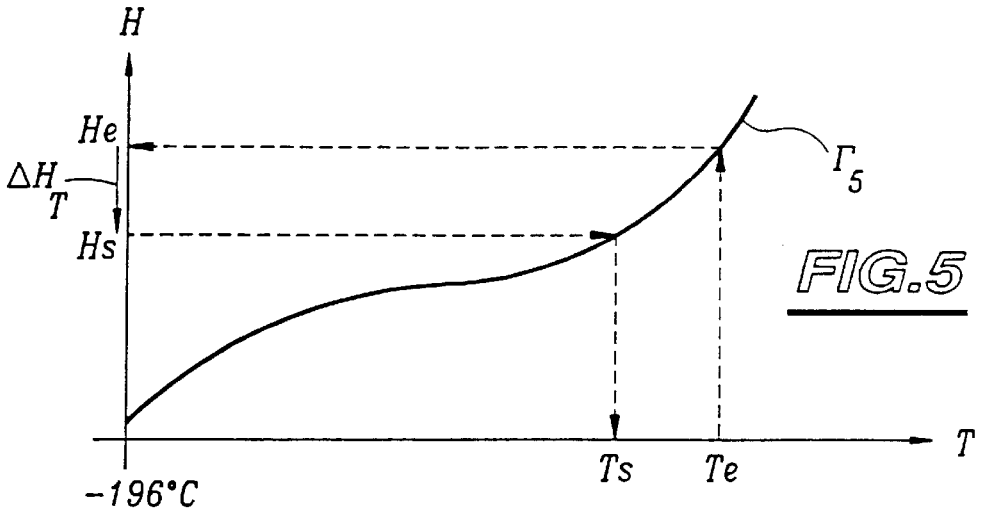
FIG. 5 is a curve illustrating the enthalpy transferred to one kilogram of products introduced into the tunnel as a function of the temperature.

The curve $G_5$, illustrated in FIG. 5, represents the variation in the enthalpy H of one kilogram of products when the temperature of the latter goes from the temperature of −189° C. (the temperature of liquid nitrogen at the storage pressure, for example equal to 2 bar absolute) to any given temperature T on the X-axis and at atmospheric pressure.

The enthalpy curve $G_5$, stored in the storage means 42, is determined experimentally.

For this purpose, one kilogram of products is immersed at a known initial temperature T in a Dewar vessel filled with liquid nitrogen and the quantity of nitrogen vaporized in order to bring the products from the initial temperature to the temperature of liquid nitrogen (−196° C.) at atmospheric pressure is measured, for example using a balance.

The enthalpy H transferred to the products in the Dewar vessel corresponds to the enthalpy of vaporization of nitrogen at the pressure in question. This value is proportional to the measured quantity of nitrogen vaporized.

Figure 6:
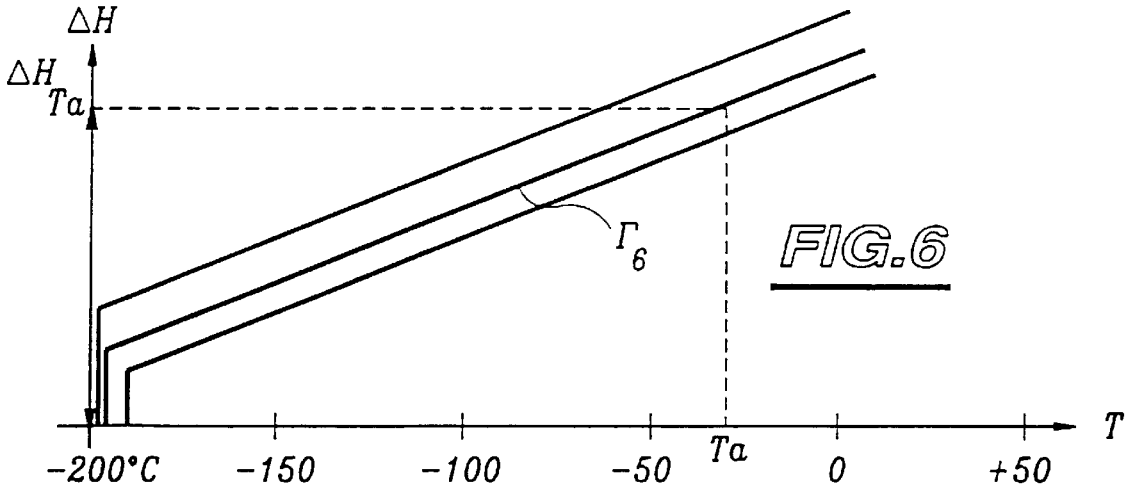
FIG. 6 is a curve illustrating the change in the enthalpy of an initially liquid liter of nitrogen as a function of the final temperature, for various pressures.

The enthalpy of vaporization at the pressure in question of a liter of liquid nitrogen is given on the curves in FIG. 6, illustrating the variation in the enthalpy of liquid nitrogen as a function of temperature for various storage pressures in thermodynamic equilibrium. In this figure, each curve corresponds to a given pressure.

The experiment is repeated for various initial temperatures a sufficient number of times to produce the curve $G_5$, the X-axis of which extends from −196° C. to +50° C.

By virtue of this curve $G_5$, the program loaded into the central computing unit 24 continuously determines the final temperature Ts of one kilogram of products leaving the tunnel, from the entrance temperature Te and from the enthalpy $DH_T$ transferred to one kilogram of products by the nitrogen introduced into the tunnel.

For this purpose, the program determines, from the curve $G_5$, the enthalpy He corresponding to one kilogram of products entering the tunnel at the temperature Te. From the enthalpy $DH_T$ transferred to the products by the nitrogen, it computes the enthalpy Hs of one kilogram of products leaving the tunnel from the equation $Hs=He-DH_T$.

By virtue of the curve $G_5$, the program finally determines the exit temperature Ts of the products, this temperature corresponding to the enthalpy Hs.

In order to allow the entrance temperature Te of the products to be computed, the central computing unit 24 is connected to a temperature probe brought into contact with the products immediately before their entrance into the tunnel. It may also be the temperature of a stabilization bath in which the products are kept before their introduction into the tunnel.

The enthalpy $DH_T$ transferred by the nitrogen to the products in the tunnel is determined in the following manner.

The curve $G_6$ gives the enthalpy DH released by one liter of liquid nitrogen when it goes, for a given pressure, from its liquefaction temperature to any given temperature T on the X-axis.

In order to determine the enthalpy released, the program determines, from the curve $G_6$, the enthalpy $DH_{Ta}$ released in the tunnel per liter of liquid nitrogen, when the latter vaporizes and goes from its storage temperature (−189° C.) to the temperature Ta of the gases leaving the tunnel.

The temperature Ta is, for example, measured inside the enclosure of the tunnel at its exit (for example 1 meter before the gas exit) by a temperature probe connected to the central computing unit 24. This temperature Ta is generally related to the set temperature of the tunnel and to the entrance temperature of the products. It is, for example, about −30° C.

Next, the program computes the crude enthalpy $DH_B$ transferred to one kilogram of products by multiplying the enthalpy $DH_{Ta}$ transferred per liter of nitrogen by the volume of nitrogen introduced into the tunnel for one kilogram of products (i.e. $DH_B=q \cdot DH_{Ta}/M_P$, where $M_P$ is the mass of products introduced into the tunnel per unit time).

The mass $M_P$ of products introduced into the tunnel per unit time is determined from the number n of products detected entering the tunnel per unit time and from the average weight of the products.

The enthalpy $DH_T$ is then calculated from the crude enthalpy $DH_B$, taking into account the thermal losses $DH_P$ of the tunnel.

The actual enthalpy losses $DH_P$ of the tunnel are determined experimentally by allowing the tunnel to operate in the absence of products for various temperature values T within the enclosure. As previously, the enthalpy due to the losses of the tunnel per unit time is determined from the volume of nitrogen consumed per unit time in order to keep the temperature T inside the enclosure constant.

The enthalpy losses of the tunnel are proportional to time, the proportionality coefficient possibly being approximated as a function of the average temperature in the tunnel by a polynomial of order 2.

Finally, the enthalpy $DH_T$ is computed by subtracting from the enthalpy $DH_B$ the enthalpy $DH_P$ of the actual losses of the tunnel divided by the mass of products introduced into the tunnel per unit time (i.e. $DH_T=DH_B-DH_P/M_P$).

The computing means used here for computing the exit temperature of the products may be used on an apparatus whose means for determining the quantity of products treated differ from those described here. In particular, the camera 22 and the optical barrier 26 may be replaced by balances, counting devices or flow meters (in the case of ice cream, for example).

It will be understood that the plant described here makes it possible to accurately determine the actual exit temperature of the products and not simply their estimated temperature. This is because the computed temperature in the present plant takes into account the number of products actually introduced into the deep-freezing tunnel and the quantity of cryogenic fluid actually introduced.

The detection means used in the present plant are insensitive to the temperature in the immediate vicinity of the entrance of the deep-freezing tunnel. This is because no mechanical moving part is employed and the optical detection means used are little influenced by the low temperatures.

In particular, the camera 22 is placed above the conveyor so that it is barely exposed to the cold, the highest temperatures being in the upper part of the plant.

Moreover, the electrical elements of the optical barrier, namely the emitter and the receiver, are placed away from the conveyor thanks to the use of the optical fibers.

As a variant (not illustrated), the camera and the optical barrier are placed over the outgoing section 16 of the conveyor.

Of course, the plant includes means for selecting the nature of the products treated in the deep-freezing tunnel so that the central computing unit 24 uses the curve of the variation in enthalpy corresponding to the products being treated, in order to compute their exit temperature.

Moreover, the flow meter 40 may be replaced by a level gauge installed in the cryogenic liquid storage tank, this gauge being suitable for indicating to the unit 24 the change in the level in the tank.

The detection means described here may be employed in a plant for the treatment of products for the purpose of invoicing the use of the treatment apparatus according to the quantity of products actually treated by the apparatus, for example per hour of operation of the plant, or else per kilogram of product treated in the plant.

Although the present invention has been described in relation to particular embodiments, it is not limited thereby but is, on the contrary, capable of modifications and of variants which will be apparent to those skilled in the art.

Thus, although the invention has been most particularly exemplified in the case of apparatuses for the deep-freezing of food products, it finds much wider application in other fields, whether or not these are in the food field. By way of illustration, mention may also be made in the food field of the case of cookers.

Likewise, although the invention has been most particularly exemplified in the case of quantitative determination of the number of products treated in the enclosure, this being achieved using the combination of a monochrome camera and an optical barrier, it will be clearly apparent to those skilled in the art that it is possible, without departing from the scope of the present invention, for example:

- to use other types of camera;
- to use an optical barrier made from several beams located one on top of another in the plane of movement of the products (P) so as to be interrupted by the products (P) traveling on the conveyor, and making it possible to obtain information about the volume of the products (depending on the number of beams interrupted heightwise during the passage);
- to use, in combination with a camera, a counting means other than an optical barrier (without excluding, moreover, a human counting means), for example an ultrasonic barrier;
- to use the camera (whatever its type) by itself, for example in order to obtain quantitative information such as the degree of occupancy of the conveyor (which, as was seen, in combination with the speed of this conveyor, makes it possible to obtain the average quantity of products treated), or else qualitative information such as the temperature of the products (whether at the entrance of the enclosure or at the exit, depending on the place where the system is positioned).

What is claimed is:

1. A plant for the treatment of food products comprising:

a. an apparatus for cooling food products by bringing the products into contact with a cryogenic fluid, b. a conveyor for introducing the products into the apparatus and for extracting said products from said apparatus, c. a detector which determines at least one of (i) a value representative of the quality and (ii) the quantity of products treated by said apparatus, said detector comprising:

i. a camera suitable for producing a digital image of a section of the conveyor intended for transporting the products, said digital image revealing said products carried by said section of the conveyor, ii. a data processing unit which includes an image processor suitable for determining the at least one of (i) the value representative of the quality and (ii) the quantity of products treated by said apparatus from said digital image, iii. a measuring device which measures the quantity of cryogenic fluid with which the products are brought into contact, connected to said data processing unit, wherein said data processing unit computes the temperature of each product leaving said apparatus depending on the value representative of the quantity of products treated and on the measured quantity of cryogenic fluid.

2. The plant according to claim 1, wherein said data processing unit stores a curve ($\lceil_5$) of the variation in enthalpy of a product as a function of its temperature, and determines the exit temperature of a product from said enthalpy curve ($\lceil_5$), from the measured quantity of cryogenic fluid, from the value representative of the quantity of products treated and from the initial temperature of the products.

3. The plant according to claim 1, wherein said camera has a line of sight which extends so as to be approximately perpendicular to the plane of movement of said conveyor.

4. The plant according to claim 1, wherein said data processing unit triggers a taking of an image at predefined triggering times and wherein said image processor computes a value representative of the density of products on the conveyor at each triggering time from said digital image of said section of the conveyor at that time.

5. The plant according to claim 4, wherein said camera is a monochrome or color camera.

6. The plant according to claim 5, wherein said camera is a color camera and said image processor analyzes the colors present in the image, allowing, by comparison with a reference color, said value representative of the density of products on the conveyor to be determined.

7. The plant according to claim 4, further comprising a distributor which places the products on said conveyor in a predetermined pattern, reproduced sequentially along said conveyor with a variable quantity of products for each pattern, connected to said data processing unit, a counter which counts the number of patterns traveling past the camera, and said data processing unit evaluates the value representative of the quantity of products treated from said value representative of the density of products on the conveyor, this being computed at each triggering time, and from the number of patterns counted.

8. The plant according to claim 7, wherein said counter includes a barrier having at least one optical beam, said barrier being connected to said data processing unit and being placed transversely to the conveyor, the beam of said barrier lying in the plane of movement of the products so as to be interrupted by the products traveling on the conveyor.

9. The plant according to claim 8, wherein the optical barrier includes, near the conveyor, an end for the emission of said at least one beam and an end for the reception of said at least one beam and wherein these two ends are associated with nozzles for ejecting a gas for protecting said ends.

10. The plant according to claim 9, wherein said gas is a hot gas.

11. The plant according to claim 7, wherein said counter comprises, near the conveyor, an ultrasonic or microwave barrier connected to said data processing unit and placing transversely to the conveyor, the beam of said barrier lying in the plane of movement of the products so as to be interrupted by the products traveling on the conveyor.

12. The plant according to claim 4, wherein said camera is an infrared camera and said image processing makes it possible to obtain a value representative of the temperature of the products on the conveyor.

13. The plant according to claim 1, wherein said image processor differentiates, in said image, those areas of the conveyor that are covered by a product from those areas of the conveyor that are left free, as well as analyzes said differentiated areas in said image in order to determine a value representative of the quantity of products treated.

14. The plant according to claim 13, wherein said image processor produces, over the entire extent of the image, a first histogram representative of the number of pixels corresponding to those areas of the conveyor that are covered by a product, for each line of the image in the direction (X—X) of movement of the conveyor, and produces, over the entire extent of the image, a second histogram representative of the number of pixels corresponding to those areas of the conveyor that are covered by a product, for each line of the image in the direction (Y—Y) perpendicular to the direction of movement of the conveyor, and compares the values of the peaks of the first and second histograms (52A, 54A) thus produced with first and second threshold values for determining the density of products treated.

* * * * *